United States Patent [19]

LeMoine

[11] 4,440,232

[45] Apr. 3, 1984

[54] WELL PRESSURE COMPENSATION FOR BLOWOUT PREVENTERS

[75] Inventor: Joseph L. LeMoine, Houston, Tex.

[73] Assignee: Koomey, Inc., Houston, Tex.

[21] Appl. No.: 401,808

[22] Filed: Jul. 26, 1982

[51] Int. Cl.[3] ..... E21B 33/06

[52] U.S. Cl. ..... 166/373; 166/53; 166/82; 166/80; 166/84

[58] Field of Search ..... 166/80, 82–84, 166/86, 53, 95, 97, 386, 373; 251/1 R

[56] References Cited

U.S. PATENT DOCUMENTS

| | | | |
|---|---|---|---|
| 2,163,813 | 6/1939 | Stone et al. | 277/28 |
| 3,145,995 | 8/1964 | Adamson et al. | 166/84 |
| 3,207,221 | 9/1965 | Cochran et al. | 166/86 |
| 3,580,586 | 5/1971 | Burns | 166/84 |
| 3,583,480 | 6/1971 | Regan | 166/82 |

*Primary Examiner*—William F. Pate, III
*Assistant Examiner*—Hoang C. Dang
*Attorney, Agent, or Firm*—Fulbright & Jaworski

[57] ABSTRACT

A method and apparatus of compensating for the closing force on a blowout preventer caused by well pressure for reducing the wear on the blowout preventer sealing element when moving a drill string through a closed blowout preventer. A hydraulic opening force is applied to the blowout preventer which is actuated by and is proportional to the well pressure. A compensating line is connected between the blowout preventer fluid supply line and the blowout preventer opening line. A control valve is provided in the compensating lines for applying an opening force on the blowout preventer and a pilot control pressure regulator is provided in the compensating line for limiting the compensating pressure. The pilot control line is connected between the regulator and the well pressure in the blowout preventer whereby the output pressure is proportional to the well pressure for compensating for the closing force on the blowout preventer caused by the well pressure.

6 Claims, 3 Drawing Figures

WELL PRESSURE COMPENSATION FOR BLOWOUT PREVENTERS

BACKGROUND OF THE INVENTION

Blowout preventers are normally opened and closed by hydraulic opening and closing lines. However, when a blowout preventer is closed around the drilling string, the well bore pressure acts in the annulus about the drilling string to keep the preventer closed. As the well pressure increases, the net closing force also increases. When the drilling string which includes enlarged joints and drill collars is moved across the blowout preventer sealing element, which is called "stripping", it creates wear on the sealing element. With the closing forces, due to both the control system "closed" pressure and the well bore pressure, compressing the sealing element against the drill string the sealing element wears out at a rapid rate during stripping operations.

The present invention is directed to a method and apparatus in which the closing force caused by the annulus or well bore pressure is reduced at the discretion of the operator and the compensation can be desired percentage of the well bore generated closing force. The compensation force is applied to the blowout preventer in an opening direction sufficient to compensate for the closing forces generated by the well pressure for reducing the wear on the blowout preventer sealing elements but without opening the blowout preventer.

SUMMARY

The present invention is directed to a method and apparatus for compensating for the closing force on a blowout preventer caused by well pressure when moving a drill string through a closed blowout preventer by applying a hydraulic opening force to the blowout preventer which is actuated by and proportional to the well pressure for reducing wear on the sealing elements of the blowout preventer. The opening force is insufficient to open the blowout preventer.

Still a further object of the present invention is the improvement in a blowout preventer control system having an opening line and a closing line connected to a control valve which in turn is connected to a fluid supply line of compensation means for reducing the effects of well bore pressure by providing a compensating line connected between the fluid supply line and the opening line of the blowout preventer. A control means is provided in the compensating line for applying an opening force on the blowout preventer. A pilot control pressure regulator in the compensating line regulates the compensating opening force. The pilot control line is connected between the regulator and the well pressure in the blowout preventer whereby the output pressure of the regulator is proportional to the well pressure for compensating for the closing force on the blowout preventer caused by the well pressure.

Yet a still further object of the present invention is wherein the regulator is downstream of the control means which is a manual valve and a shuttle valve is positioned at the connection of the compensating line in the opening line.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

While the present invention will be described in connection for compensating for the well pressure on an annular type blowout preventer, for purposes of illustration, it is recognized that the present method and apparatus is also applicable to other types of blowout preventers such as ram type blowout preventers.

Figure 1:
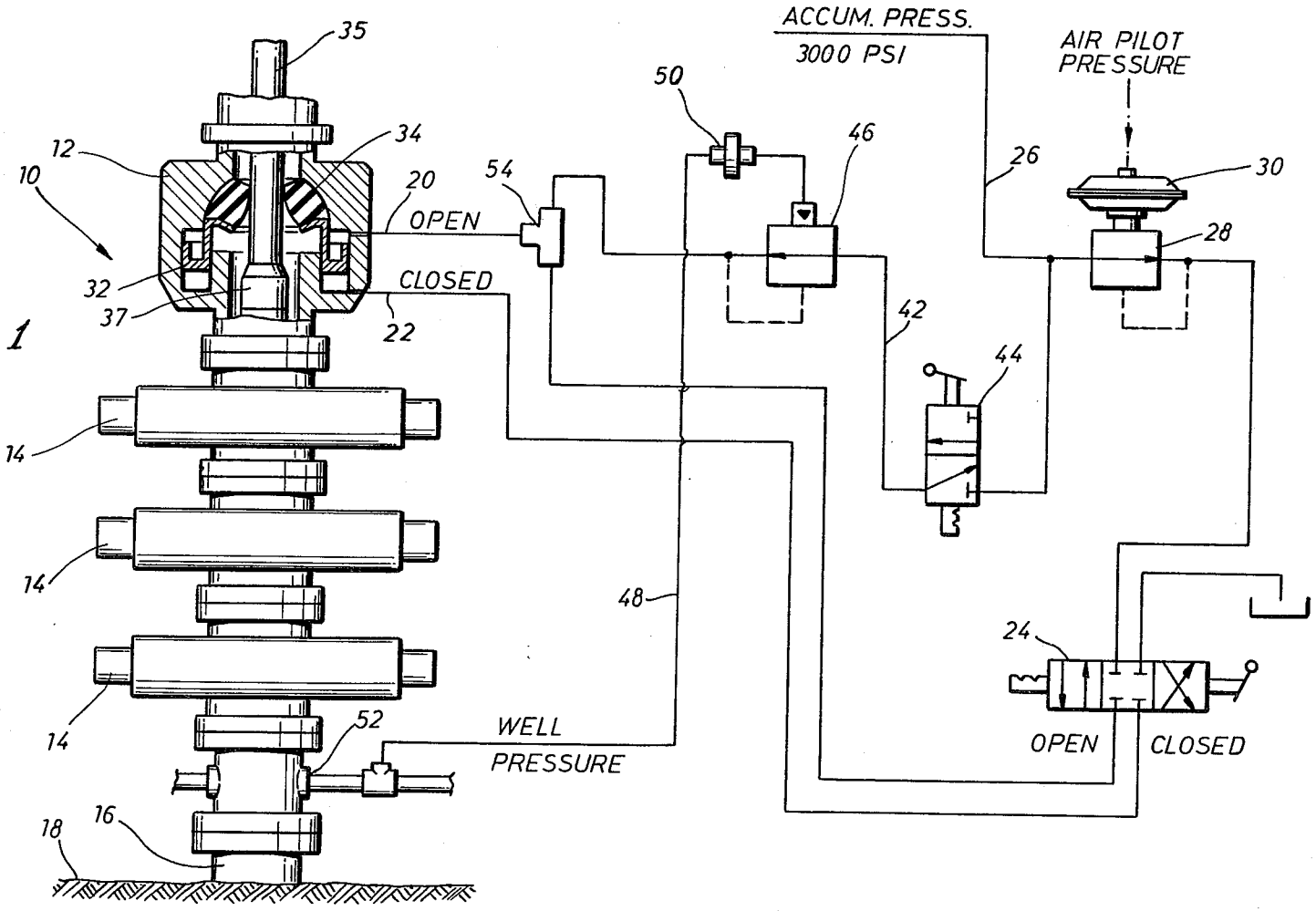
FIG. 1 is a schematic view of the well pressure compensating system for a blowout preventer of the present invention.

Referring now to FIG. 1, a blowout preventer stack generally indicated by the reference numeral 10 is shown which includes an annular blowout preventer 12 and a plurality of ram type preventers 14. The preventers 12 and 14 are connected to the wellhead 16 which extends downwardly into a well in the ground 18.

The annular blowout preventer 12 is connected to a hydraulic opening line 20 and a hydraulic closing line 22 which in turn are connected to a control valve 24 which is connected to a hydraulic supply power line 26 and may include a regulator 28 with an air pilot pressure control 30 for regulating a supply of fluid. When the valve 24 is moved to a "closed" position, hydraulic fluid flows to the closed line 22 beneath a piston 32 in the blowout preventer 12 which moves upwardly against the sealing element 34 to move it inwardly for sealing off against the exterior of the drilling string 35. When the valve 24 is moved to the "open" position, hydraulic fluid from the supply 26 is transmitted through opening line 20 to above the piston 32 to move the piston 32 downwardly to retract the resilient sealing element 34.

The above general description and operation of a blowout preventer is generally conventional.

Figure 2:
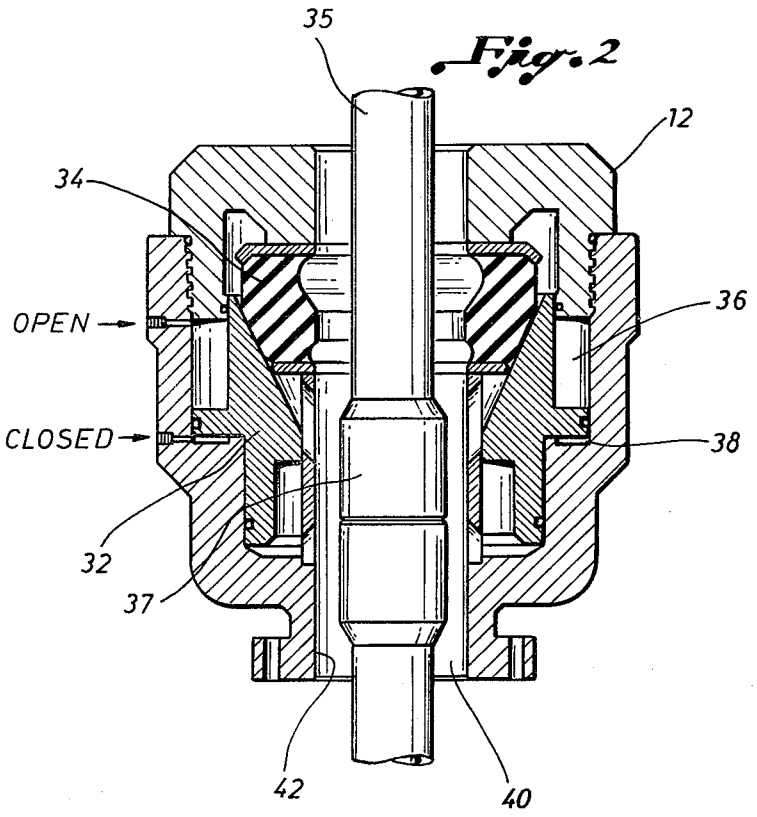
FIG. 2 is an enlarged cross-sectional view of a conventional annular type blowout preventer.

Referring now to FIG. 2, an enlarged cross-sectional area of a typical annular blowout preventer such as the type GK sold by Hydril Company. The opening line 20 is connected to an opening chamber 36 and the closing line 22 is connected to a closing chamber 38. Generally, the cross-sectional area of the closing chamber 38 is larger than the opening chamber 36 for insuring that the sealing element 34 is firmly and securely moved into a sealing position.

However, when the blowout preventer 12 is closed, the well bore pressure in the well acts in the annulus 40 between the bore 42 of the blowout preventer 12 and the exterior of the drilling string 35. This well or annulus pressure acts on the piston 32 and on the seal element 34 in a direction to keep the preventer 12 closed. As the well pressure increases, the net closing force also increases. When the drilling string 35 which includes tool joints 37 moves across the closed sealing element 34, which is called "stripping" the joints 37 act on the resilient sealing element 34 and where these elements wear at a rapid rate. That is, the closing forces due to the hydraulic closing pressure in chamber 38 and the well pressures acting through the annulus 40 attempt to keep the resilient sealing element 34 moved inwardly on the drilling string 35 and are subjected to wear as the drilling string 35 moves therethrough.

The present invention is directed to at least partially compensating for the closing force exerted by the well pressure in the annulus 40 to thereby reduce the closing force of the seal element 34 on the string 35, but without sacrificing safety, and preferably it is desirable that the compensating force be proportional to the well pressure.

The present invention provides compensation for reducing the effects of the well bore pressure by providing a compensating line 42 connected between the fluid supply line 26 and the opening line 20. A control means, such as a control valve 44, is provided in the line 42 which may be any suitable type of three-way manual valve for actuating and deactuating the compensation system. A pilot control pressure regulator 46 is provided connected in the compensating line 42, preferably downstream from the valve 44 for regulating the pressure in the line 42. A pilot control line 48 is connected between the regulator 46, preferably through a diaphragm interface 50, and to the well pressure by a connection 52. Therefore, the output pressure of the regulator 46 and thus of the compensating force acting to open the blowout preventer valve is proportional to the well pressure. Preferably, a shuttle valve 54 is provided at the connection of the compensating line 42 and the opening line 20 for insuring that only one of the lines 42 and 20 is applied to open the blowout preventer 12. The compensating force then acts in the opening chamber 36 against the piston 32 to at least partially compensate for the closing force created by the well pressure.

In operation, the blowout preventer 12 is operated in the normal way by the use of the control valve 24. However, if the operator wants to strip then the activate/deactivate control valve 44 is put in the activate position which will supply fluid pressure to the regulator 46. The output pressure of the regulator 46 which is piloted to and controlled by the well bore pressure, is proportional to the well pressure. Therefore, if the well pressure increases and increases the closing force, the present compensating system will increase the opening force during the stripping operation. On the other hand, if the well pressure decreases, the opening force will also decrease so as not to inadvertently overcome the closing force and open the blowout preventer.

Since the sealing element 34 seals off across the entire annulus to engage the exterior of the drilling string 35 different sized drilling strings 35 will have different effects. For example, in a 13⅝ inch BOP the cross-sectional area of the open chamber 36 is 386 square inches. The annulus area 40 with a four inch pipe therethrough would be 600 square inches. Therefore the ratio of the annulus cross-sectional area to the open chamber cross-sectional area is 1.55. Therefore, to provide 100% compensation the pressure in the open chamber 36 would have to be 155 percent of the well pressure.

Figure 3:
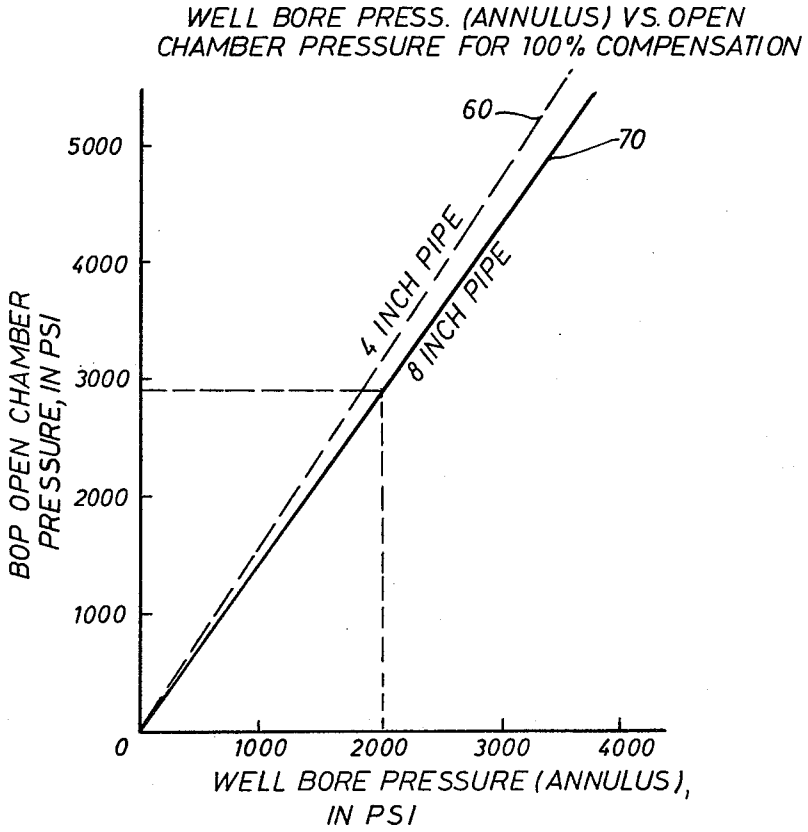
FIG. 3 is a graph showing the relationship of the well bore pressure versus the open chamber pressure of the blowout preventer for 100% compensation of the well bore pressure for various sized pipes.

Referring now to FIG. 3, a chart of well bore pressure versus pressure in the open chamber 36 for 100% pressure compensation is shown. The graph 60 for the four-inch pipe is shown for a 1.55 ratio which indicates that if the well bore pressure is 2000 psi then the pressure in the chamber 36 must be 3100 psi to 100% compensate for the well pressure. If the drilling string 35 was a nominal eight-inch pipe size, the ratio is 1.44 and the graph for the eight-inch pipe is shown as 70. For 100% compensation for an eight-inch pipe, assuming a well bore pressure of 2000 psi, the open chamber 36 pressure would need to be 2880 psi. Of course, it is not necessary to compensate 100% for the annulus or well bore pressure and the compensation can be at the discretion of the operator and can be any desired proportion of the well bore generated closing force. The ratios would be different for percentages of compensation other than 100%.

It may not be desirable to overcompensate for the well pressure closing force or the preventer 12 may retract the sealing element 34 to a degree which would endanger the safety of the well. However, this possibility is avoided by using the well pressure to control the regulator 46 to insure that the output pressure of the regulator 46 is proportional to the well pressure.

The method of the present invention is apparent from the description of the froegoing apparatus of the present invention. However, the method includes compensating for the closing force on a blowout preventer caused by well pressure when moving a drill string through a closed blowout preventer including applying a hydraulic opening force to the blowout preventer actuated by and proportional to the well pressure for reducing wear on the blowout preventer. The method further comprehends that the opening force is insufficient to open the blowout preventer.

The present invention, therefore, is well adapted to carry out the objects and attain the ends and advantages mentioned a well as other inherent therein. While a preferred embodiment of the invention has been given for the purpose of disclosure, numerous changes in the details of construction and arrangement of parts, and steps of the method, will readily suggest themselves to those skilled in the art and which are encompassed within the spirit of the invention and the scope of the appended claims.

What is claimed is:

1. In a blowout preventer control system having an opening line and a closing line connected to a control valve which is connected to a fluid supply line, the improvement of compensation means for reducing the effects of well bore pressure comprising, a compensating line connected between the fluid supply line and the opening line, a control means in the compensating line for applying an opening force on the blowout preventer, a pilot control pressure regulator in the compensating line, and a pilot control line connected between the regulator and the well pressure in the blowout preventer whereby the output pressure of the regulator is proportional to the well pressure for compensating for the closing force on the blowout preventer caused by the well pressure.

2. The apparatus of claim 1 wherein the regulator is downstream of the control means.

3. The apparatus of claim 1 including, a shuttle valve positioned at the connection of the compensating line and the opening line.

4. The method of compensating for the closing force on a blowout preventer caused by well pressure when withdrawing a drill string through a closed blowout preventer comprising, when withdrawing a drill string through a closed blowout preventer applying a hydraulic closing force to the blowout preventer from an external fluid supply source for closing the blowout preventer on the drill string, and applying a hydraulic opening force to the blowout preventer actuated by and proportional to the well pressure for reducing wear on the blowout preventer.

5. The method of claim 4 wherein the opening force is insufficient to open the blowout preventer.

6. In a double acting blowout preventer control system having an opening piston surface and a closing piston surface connected to a control valve which is connected to an external fluid supply line and in which the well bore pressure acts on the blowout preventer in a direction to close the blowout preventer, the improvement of compensation means for reducing the effects of the well bore pressure comprising, a compensating line connected between the external fluid supply line and the opening piston surface for supplying fluid on the opening piston surface acting to open the blowout preventer, control means connected to the compensating line for applying an opening force on the blowout preventer, and means connected between the compensating line and the well bore pressure for varying the opening force applied to the blowout preventer proportional to the well pressure for compensating for the closing force on the blowout preventer caused by the well pressure.

* * * * *